US006739692B2

(12) United States Patent
Unosawa

(10) Patent No.: US 6,739,692 B2
(45) Date of Patent: May 25, 2004

(54) INK JET RECORDING APPARATUS

(75) Inventor: Yasuhiro Unosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 10/133,676

(22) Filed: Apr. 29, 2002

(65) Prior Publication Data

US 2002/0175968 A1 Nov. 28, 2002

(30) Foreign Application Priority Data

May 10, 2001 (JP) ..... 2001-139972

(51) Int. Cl.[7] ..... B46J 2/165

(52) U.S. Cl. ..... 347/22; 367/29; 367/30; 367/33; 367/86

(58) Field of Search ..... 347/22, 14, 19, 347/24, 29, 30, 32, 33, 35, 36, 49, 86

(56) References Cited

U.S. PATENT DOCUMENTS 5,289,213 A * 2/1994 Murai et al. ..... 347/28
5,604,523 A * 2/1997 Tsukuda et al. ..... 347/86
5,671,000 A * 9/1997 Hirabayashi et al. ..... 347/86
5,975,665 A 11/1999 Torigoe et al. ..... 347/7
6,050,673 A 4/2000 Wada et al. ..... 347/37
6,582,041 B1 * 6/2003 Tsuruoka ..... 347/12

FOREIGN PATENT DOCUMENTS

EP 1080900 3/2001
JP 404027559 A * 1/1992 ..... 347/86
JP 9-70962 3/1997

* cited by examiner

*Primary Examiner*—Shih-Wen Hsieh
(74) *Attorney, Agent, or Firm*—Fitzpatrick, Cella, Harper & Scinto

(57) ABSTRACT

The present invention provides an ink jet recording apparatus including a carriage to which a recording head for effecting recording on a recording material by discharging ink and an ink tank for containing ink to be supplied to the recording head are detachably mounted in a separate exchanging permitting manner and which shifts the recording head and the ink tank in a direction perpendicular to a conveying direction of the recording material, comprising an ink tank exchanging position which is a position of the carriage, where the ink tank is to be exchanged, and a recording head exchanging position which is different from the ink tank exchanging position and which is a position of the carriage where the recording head is to be exchanged.

30 Claims, 7 Drawing Sheets

INK JET RECORDING APPARATUS

BACKGROUND OF THE INVENTION

1. Field of the Invention

The present invention relates to an ink jet recording apparatus for recording characters and/or images on a recording material by using a recording head of ink jet type, and more particularly, it relates to an ink jet recording apparatus in which a recording head and an ink tank which are detachably interconnected are mounted on a carriage.

2. Related Background Art

A recording apparatus having a printer function, a copier function or a facsimile function or a recording apparatus used as an output device for a work station or a composite electronic equipment including a computer or a word processor is designed so that a character and/or an image is recorded on a recording sheet such as a paper or a thin plastic film on the basis of character information or image information. Depending upon a recording system, such recording apparatuses can be divided into an ink jet type, a wire dot type, a thermal type, an electrophotographic type and the like.

Among them, as a recording apparatus for in individual user, a recording apparatus of ink jet type (referred to as "ink jet recording apparatus" hereinafter) has mainly been developed for the reasons that a sharp full-color image can be obtained at a relatively high speed and the apparatus itself can easily be made compact. General or popular ink jet recording apparatuses are of serial scanning type comprising a carriage for reciprocally shifting a recording head (mounted on the carriage) in a main scanning direction, convey means for conveying a recording material such as a recording sheet in a direction (sub scanning direction) perpendicular to the main scanning direction, and control means for controlling them. In the ink jet recording apparatus of serial scanning type, after the recording sheet is set at a predetermined recording position, main scanning of the recording head and sub scanning of the recording sheet at a predetermined pitch are repeated so that the recording is effected on the entire recording sheet by discharging ink from the recording head during the main scanning of the recording head.

As recording heads used in the ink jet recording apparatus, there are a so-called permanent recording head having a service life greater than the recording apparatus itself, and disposable recording head can be replaced or exchanged.

In the ink jet recording apparatus using the permanent head, the recording head is fixedly attached to the carriage and an ink cartridge for containing ink to be supplied to the recording head is detachably attached to the carriage. Since the recording head is designed to discharge the ink from minutes nozzles, it is very difficult to completely eliminate accidental malfunction due to clogging of nozzles with foreign matters or viscosity-increased ink or time-lapse malfunction due to deterioration of energy generating elements for generating energy for discharging the ink. Accordingly, in the ink jet recording apparatus using the permanent head, it is generally required to have special maintenance in order to ensure reliability of the recording apparatus itself by maintaining the discharging property of the recording head.

On the other hand, in the ink jet recording apparatus using the disposable head, the recording head integrally connected to the ink tank is detachably mounted on the carriage. Accordingly, when the ink is used up, since the recording head is also exchanged together with exchange of the vacant ink tank, there is almost no malfunction of the recording head. However, from the viewpoints that load in carriage movement must be reduced and that the reliability of the recording head must be maintained, increase of volume of the ink tank is limited. As a result, frequency for exchanging the ink tank is increased, with the result that the recording head is also exchange frequently, which leads to disadvantages that the running cost is increased to give burden to the user and the recording head which can still be utilized must be discarded. This is contrary to solution of the recent world wide environmental problems.

To avoid this, there has been proposed an ink jet recording apparatus in which a recording head is coupled to an ink tank in such a manner that they can be detached from each other by the user and the recording head and the ink tank are independently detachable and exchangeable with respect to the carriage, while maintaining features of a disposable head and preventing increase in the running cost and deterioration of earth environment. Further, there has been proposed an ink jet recording apparatus in which the carriage detachably mounts thereon the recording head and the ink tank in the coupled condition. With this arrangement, when ink in the ink tank is used up or consumed, the ink tank alone can be exchanged, and, if the recording head is damaged, the recording head alone can be exchanged, and both can be exchanged if necessary.

In such ink jet recording apparatuses, when the ink tank and the like is exchanged, the carriage is shifted to an exchanging position, where only the ink tank or the only the recording head or the coupled recording head/ink tank is exchanged by the user.

By the way, as mentioned above, in the recording head used in the ink jet recording apparatus, the nozzles may be clogged with the foreign matters and/or viscosity-increased ink. In a condition that the nozzles are clogged, a desired discharging property cannot be obtained, and malfunction may occur if worst comes to worst. To avoid this, in general, the ink jet recording apparatus is provided with a head recovery unit for maintaining the discharging property of the recording head by removing the foreign matters and the like from the nozzles. The head recovery unit includes a cap for capping a nozzle opening face of the recording head, and suction means for forcibly sucking the foreign matters and the like from the nozzles in a condition that the nozzle opening face is capped.

Recovery processing of the head recovery unit regarding the recording head is performed when the power supply of the ink jet recording apparatus is turned ON, before a recording operation, at a predetermined timing during the recording operation and/or after the ink tank or the recording head is exchanged.

However, in the ink jet recording apparatus of type in which the recording head and the ink tank can be exchanged independently (referred to as "ink jet recording apparatus of recording head/ink tank separate exchanging type" hereinafter), since the recording head can be dismounted and the ink tank can also be dismounted from the carriage, the user who wished to exchange the ink tank may dismount the recording head erroneously or the user who wishes to exchange the recording head may dismount the ink tank erroneously.

Further, as mentioned above, although the recovery processing of the recording head is effected by the head recovery unit in the conventional ink jet recording apparatuses, in the ink jet recording apparatus of recording head/ink tank separate exchanging type, from the investigation by the Inventors and the like, it was found that the required recovery processing is different between when the ink tank is exchanged and when the recording head is exchanged.

For example, when the ink tank is exchanged, air may enter into a connecting portion between the ink tank and the recording head. In this case, since the air obstructs supplying of the ink from the ink tank to the recording head, the air must be removed before the recording operation is started.

Further, when the recording head is exchanged, an aging operation of the recording head itself including preliminary discharge independent from the recording must be performed and the ink viscosity of which was increased in the nozzles during the material transportation must be removed.

In any cases, the recovery processing consumes the ink, and, due to the difference in the recovery processing as mentioned above, a consumed amount of the ink becomes different between when the ink tank is exchanged and when the recording head is exchanged. Namely, the amount of ink required for the recovery processing when the ink tank is exchanged is smaller than that when the recording head is exchanged. However, in the conventional ink jet recording apparatuses, there is no judging means for judging whether the fact that the ink tank was exchanged or the fact that the recording head was exchanged, and the same recovery processing is effected, with the result that the useful ink is wasted when the ink tank is exchanged.

Further, since the frequency for exchanging the ink tank is considerably greater than the frequency for exchanging the recording tank, when the user's convenience, an ink jet recording apparatus in which the ink tank can easily be exchanged is desired or needed.

SUMMARY OF THE INVENTION

Therefore, an object of the present invention is to provide an ink jet recording apparatus in which the fact that the user who tries to exchange an ink tank dismounts other member such as a recording head erroneously or vice versa can be eliminated.

Another object of the present invention is to provide an ink jet recording apparatus of recording head/ink tank separate exchanging type in which consumption of ink is suppressed in head recovery processing when a recording head is exchanged.

A further object of the present invention is to provide an ink jet recording apparatus of recording head/ink tank separate exchanging type in which an ink tank having exchanging frequency greater than that of a recording head can easily be effected.

The other object of the present invention is to provide an ink jet recoding apparatus including a carriage movable in a direction perpendicular to a recording material conveying direction and adapted to detachably hold a recording head and an ink tank which are coupled together in a separate exchanging permitting manner, comprising an ink tank exchanging position which is a position of the carriage where the ink tank is to be exchanged, and a recording head exchanging position which is different from the ink tank exchanging position and which is a position of the carriage where the recording head is to be exchanged.

DETAILED DESCRIPTION OF THE PREFERRED EMBODIMENTS

Now, an ink jet recording apparatus according to an embodiment of the present invention will be explained with reference to the accompanying drawings.

Figure 1:
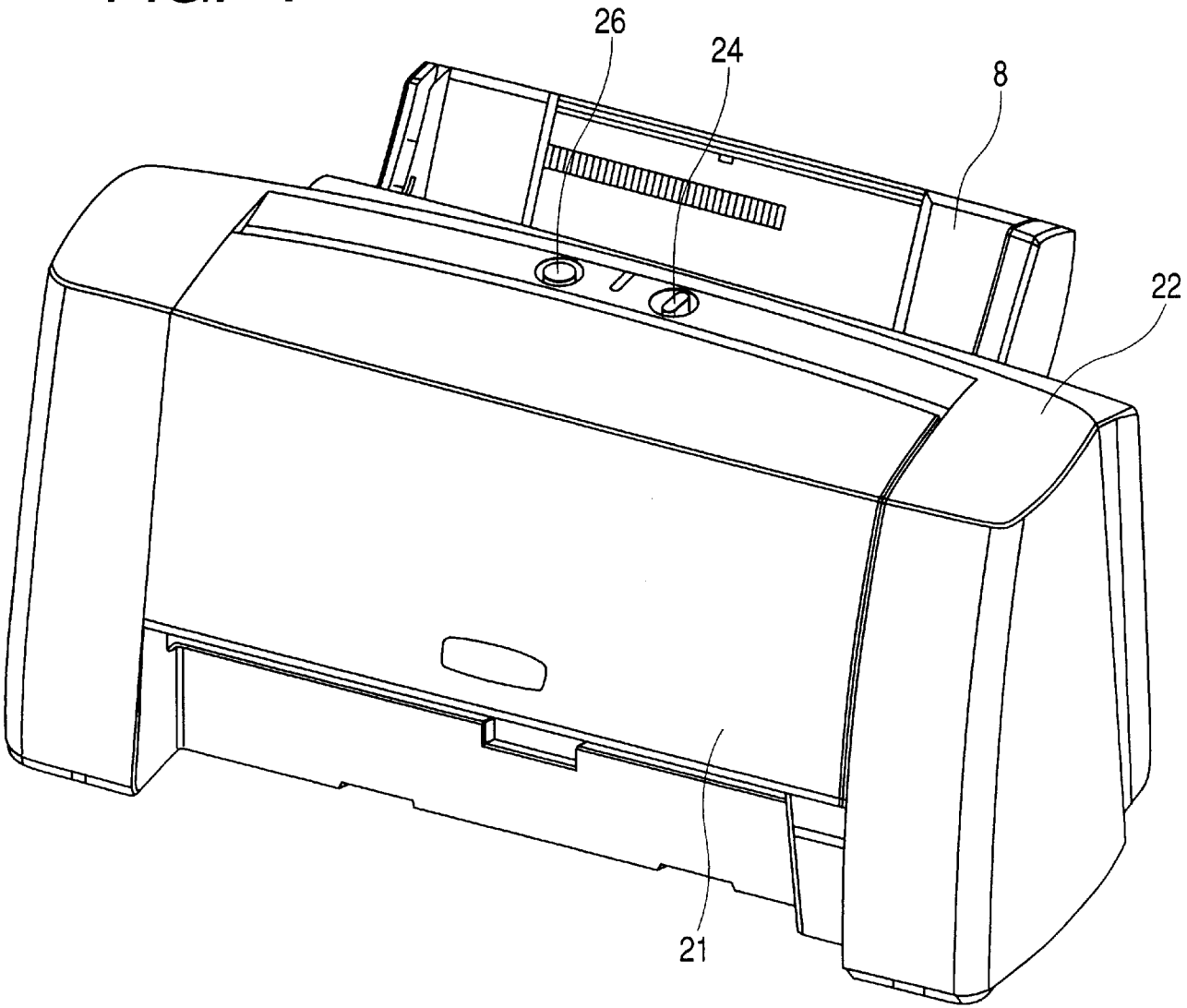
FIG. 1 is a perspective view showing an appearance of an ink jet recording head according to an embodiment of the present invention.
Figure 2:
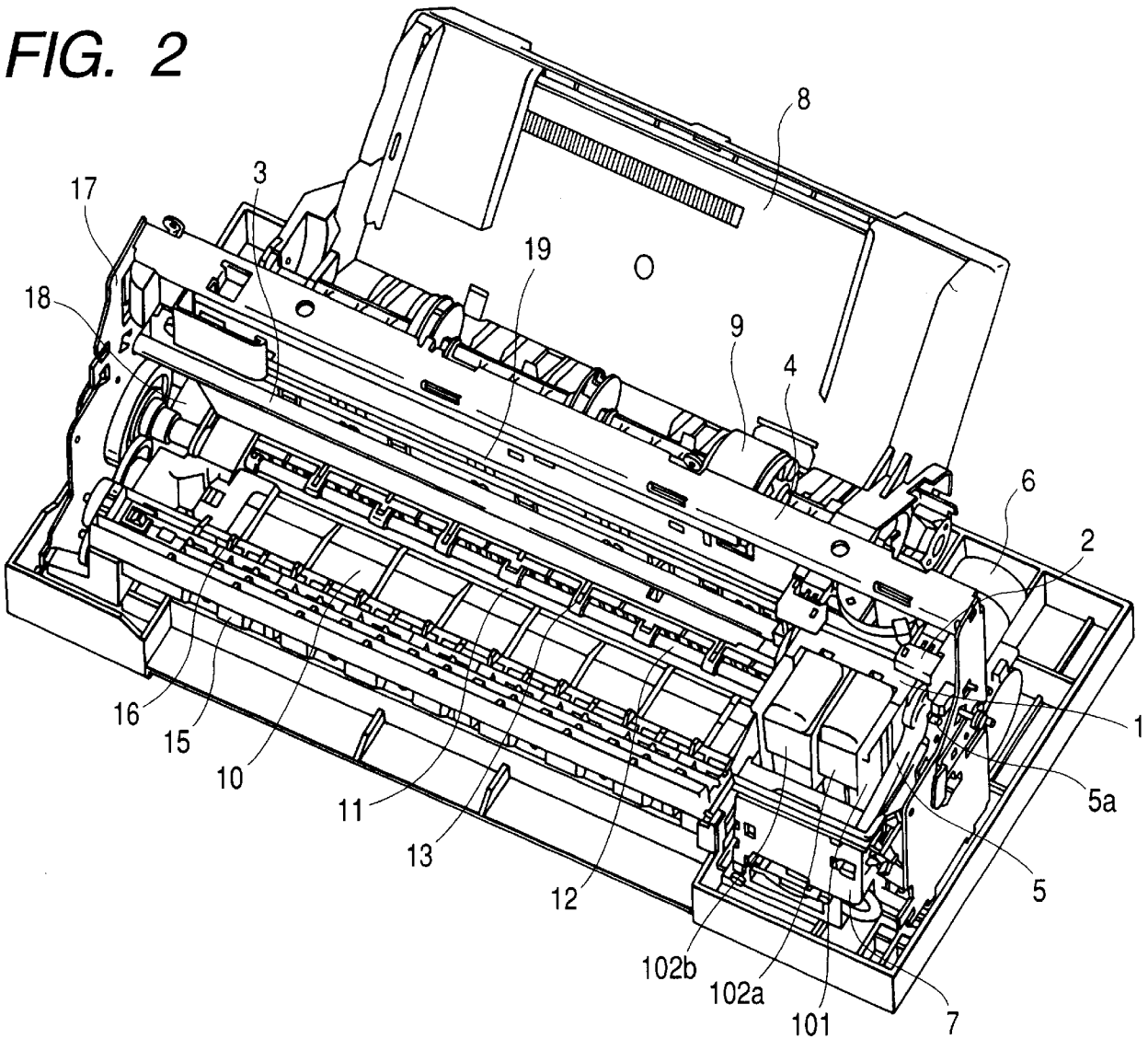
FIG. 2 is a perspective view of a recording mechanism portion of the ink jet recording apparatus of FIG. 1.

FIG. 1 is a perspective view showing an appearance of an ink jet recording head according to an embodiment of the present invention. Further, FIG. 2 is a perspective view of a recording mechanism portion of the ink jet recording apparatus of FIG. 1. In this ink jet recording apparatus, the recording mechanism portion shown in FIG. 2 is covered by an outer cover.

As shown in FIG. 2, a carriage 2 is slidably supported on a carriage shaft 3 and a guide rail 4 which are secured to a chassis 17 at their both ends in a parallel manner. An ink jet cartridge 1 (described later) is detachably and exchangeably mounted on the carriage 2, and a head securing lever 5 for securing the ink jet cartridge 1 to the carriage 2 is rotatably provided around a support shaft 5*a*. The head securing lever 5 has an operation portion which is positioned in front of the ink jet cartridge 1 in a condition that the ink jet cartridge 1 is secured, so that securing of the ink jet cartridge 1 to the carriage 2 can be released by lifting the operation portion and rotating the latter around the support shaft 5*a*.

Further, in the ink jet cartridge 1 according to the illustrated embodiment, a recording head portion 101 which can be opposed to a platen 10 during a reciprocal scanning operation of the carriage 2 is integrally attached to a frame which can detachably hold ink tanks 102*a*, 102*b*. The entire frame of the ink jet cartridge 1 is detachable with respect to the carriage 2. Accordingly, the ink tanks 102*a*, 102*b* are detachable with respect to the frame of the ink jet cartridge 1 and accordingly the recording head portion 101.

As shown in FIG. 2, a concrete construction of the ink jet cartridge 1 according to the illustrated embodiment includes the recording head portion 101, and the two ink tanks 102*a*, 102*b* contained in a holder-shaped tank containing portion provided in the frame of the ink jet cartridge 1. When the ink tanks 102*a*, 102*b* are contained in the holder-shaped tank containing portion, the ink tanks are coupled to the recording head portion 101 in an ink supplying permitting and detachable and exchangeable condition.

The head securing lever 5 serves to the frame of the ink jet cartridge 1, i.e., the recording head portion 101 to the carriage 2 but does not secure the ink tanks 102*a*, 102*b* to the carriage 2 directly. Accordingly, even in the condition that the ink jet cartridge 1 is secured to the carriage 2 by the head securing lever 5, the ink tanks 102*a*, 102*b* can independently be dismounted from the recording head portion 101, respectively.

However, in the illustrated embodiment, in a condition that the ink tank 102*a* or the ink tank 102*b* is mounted to the ink jet cartridge 1, when the ink jet cartridge 1 is mounted or dismounted with respect to the carriage 2, the ink tank 102*a* or the ink tank 102*b* is also mounted or dismounted together with the recording head portion 101. Further, in a condition that the ink tank 102*a* and the ink tank 102*b* are not mounted to the ink jet cartridge 1, when the ink jet cartridge 1 is mounted or dismounted with respect to the carriage 2, only the recording head portion 101 is mounted or dismounted with respect to the carriage 2.

The recording head portion 101 includes ink discharge means having elements for generating thermal energy utilized for discharging ink (liquid) from nozzles (among ink jet recording systems). The ink discharge means includes heat generating resistance members (electrothermal converters) as means for generating thermal energy disposed within the nozzles so that the ink is discharged from a discharge port as an open end of the nozzle by utilizing pressure of a bubble created by film boiling of the ink in the nozzle caused by the heat generating resistance member. Incidentally, the recording head portion 101 has a face in which a plurality of nozzle open ends (ink discharge ports) for discharging the ink are arranged, which face is referred to as an ink discharge face.

In the present invention, the system for discharging the ink is not limited to the above-mentioned arrangement, but, for example, a system in which mechanical vibration energy is applied to the ink by using an electrical/mechanical converting element such as a piezo-electric element and the ink is discharged by utilizing pressure due to such vibration may be used.

Each of the ink tanks 102*a*, 102*b* is provided at its bottom surface with an ink supply opening portion. On the other hand, the tank containing portion of the frame of the ink jet cartridge 1 formed integrally with the recording head portion 101 is provided with ink receiving openings which are opposed to the ink supply opening portions of the ink tanks 102*a*, 102*b* when the ink tanks are mounted. When the ink tanks 102*a*, 102*b* are mounted to the tank containing portion, the ink tanks 102*a*, 102*b* are mounted to the recording head portion 101, with the result that the ink supply opening portions of the ink tanks 102*a*, 102*b* are connected to the ink receiving openings of the recording head portion 101, thereby permitting the supplying of the ink from the ink tanks 102*a*, 102*b* to the recording head portion 101.

In the illustrated embodiment, the ink tank 102*a* contains black ink therein and the ink tank 102*b* contains three color inks (yellow, magenta and cyan inks) in its three compartments. Thus, three ink supply opening portions for three color inks are provided in the ink tank 102*b*, and, thus, the recording head portion 101 has four ink receiving openings corresponding to four colors. However, colors and kinds of the inks contained in the ink tanks and the number of ink tanks mounted to the recording head portion 101 may be selected appropriately; for example, the ink tank 102*b* may contain four color (black, yellow, magenta and cyan) inks.

A timing belt 19 is connected to the carriage 2 so that the carriage 2 can be reciprocally shifted along an axis of the carriage shaft 3 by driving the timing belt 19 by means of a carriage drive motor 6 secured to the chassis 17. A DC motor can be used as the carriage drive motor 6. Further, a linear encoder for detecting a position of the carriage 2 in the shifting direction is mounted to the ink jet recording apparatus. Although the kind of the linear encoder is not particularly limited, for example, it may be constituted by slitted scale (not shown) provided on the chassis 17, and an optical sensor provided on the carriage 2 and adapted to read the scale.

A recording sheet is conveyed toward that side to this side of the ink jet recording apparatus in a direction transverse to (perpendicular to, in the illustrated embodiment) the shifting direction of the carriage 2. An auto sheet feeder 8 for stacking the recording sheets is provided on a rear surface of the chassis 17.

A conveying path for the recording sheet supplied from the auto sheet feeder 8 includes a sheet feeding roller 9 for separating the recording sheets stacked in the auto sheet feeder 8 one by one in cooperating with separation means and for feeding out the separated recording sheet, a conveying roller 11 rotatingly driven by a sheet feed motor 18 secured to the chassis 17, pinch rollers 12 urged against the conveying roller 11 by biasing springs 13, a platen 10 opposed to the recording head portion 101 with a predetermined gap therebetween within a shifting range of the carriage 2, a sheet discharge roller 15 rotatingly driven and disposed at a downstream side of the platen 10, and driven rotary members 16 urged against the sheet discharge roller 15. Each driven rotary member 16 has a spur shape to minimize a contact area between this member and the sheet discharge roller 15. Incidentally, the conveying roller 11 and the sheet discharge roller 15 are rotatably held by the chassis 17.

Further, within the reciprocal shifting range of the carriage 2 and out of the platen, a recovery unit 7 for recovering an ink discharging function of the ink jet cartridge 1 and for maintaining an ink discharging property is provided on the chassis 17 in a confronting relationship to the ink discharge face of the recording head portion 101. The recovery unit 7 includes a cap portion for covering the ink discharge face of the recording head portion 101, a suction mechanism (not shown) for forcibly sucking the ink from the recording head portion 101 to remove residual bubbles and viscosity-increased ink from the nozzles in a condition that the ink discharge face is capped, and a cleaning blade (not shown) for wiping off contaminants on the ink discharge face. The recovery processing of the ink jet cartridge 1 is performed by appropriately combining above-mentioned suction operation effected by the suction mechanism after the ink jet cartridge 1 was opposed to the recovery unit 7 by shifting the carriage 2, a wiping operation of the cleaning blade for wiping the ink discharge face, and discharge (preliminary discharge) of ink from the recording head portion 101 other than the recording ink discharge.

In the illustrated embodiment, the position where the ink jet cartridge 1 is opposed to the recovery unit 7 is defined as a home position (reference position), and all operations for the carriage 2 and control of the ink discharge from the recording head portion 101 is effected using the home position as reference and on the basis of a detection result of the position of the carriage obtained by the linear encoder.

Next, a recording operation of the ink jet recording apparatus according to the illustrated embodiment will be explained.

The recording sheets stacked in the auto sheet feeder 8 are separated one by one by the sheet feeding roller and the separation means and the separated sheet is fed. The fed recording sheet is pinched between the conveying roller 11 and the pinch rollers 12 and is conveyed between the ink jet cartridge 1 and the platen 10 by the rotation of the conveying roller 11.

After the recording sheet is conveyed at a predetermined position, the conveyance of the recording sheet is stopped, and the carriage 2 is shifted along a recording surface of the recording sheet in a width-wise direction of the sheet (perpendicular to the conveying direction). In synchronous with the shifting movement of the carriage, by discharging the ink from the recording head portion on the basis of recording information, one-line recording is effected on the recording sheet. Then, the recording sheet is conveyed by a predetermined pitch, and then, the next recording is effected by the recording head portion 101 while shifting the carriage 2. In this way, by repeating the one-line recording effected by the recording head portion 101 and the conveyance of the recording sheet by the predetermined pitch alternately, the entire recording sheet is recorded. In this case, a recorded line may be partially overlapped with a next recorded line.

The reciprocal shifting movement of the carriage 2 while detecting the position of the carriage 2 by means of the linear encoder and feedback-controlling the carriage drive motor 6 by means of a control portion (not shown) on the basis of the carriage position. Since a driving timing of the recording head portion 101 (ink discharging timing) is determined on the basis of position data of the carriage 2 obtained by the linear encoder, the ink discharge from the recording head portion 101 is effected in synchronous with the scanning of the carriage 2.

The recording sheet on which the recording was effected by the ink discharge from the ink jet cartridge 1 is passed through the platen 10 and then is discharged out of the ink jet recording apparatus while being pinched between the sheet discharge roller 15 and the spurs (driven rotary members) 16.

As mentioned above, in the ink jet cartridge 1, the ink tanks 102*a*, 102*b* can be separated from the recording head portion 101, so that, if the ink in the ink tank 102*a* or in the ink tank 102*b* is used up, new ink is replenished by exchanging the ink tank having no ink to a new one, and the recording head portion 101 continues to be used. Further, if the ink discharge means of the recording head portion 101 reaches its service life or if inconvenience such as breaking of electrical wirings of the electrothermal converters occurs for any reason, the recording head portion 101 is exchanged by exchanging the ink jet cartridge 1, and the ink tanks continue to be used, thereby permitting the recording of the ink jet recording apparatus.

Now, the exchanging of the ink tanks 102*a*, 102*b* and the exchanging of the ink jet cartridge 1 (i.e., exchanging of the recording head portion 101) in the ink jet recording apparatus according to the illustrated embodiment will be explained.

In the illustrated embodiment, the exchanging of the ink tanks 102*a*, 102*b* and the exchanging of the ink jet cartridge 1 are performed in different operation modes.

First of all, the exchanging of the ink tanks 102*a*, 102*b* will be described.

As shown in FIG. 1, the recording mechanism portion of the ink jet recording apparatus shown in FIG. 2 is covered by a main case 22 as an outer frame except for the auto sheet feeder 8. Although the main case 22 is made of resin, it may be constituted by a combination of plural parts or by one-piece member. On an upper surface of the main case 22, there are provided a power supply button 26 for turning ON/OFF the ink jet recording apparatus, and a reset button 24 used for resetting the ink jet recording apparatus mainly if abnormality occurs in the ink jet recording apparatus.

An openable/closable access cover 21 is provided on a front side of the main case 22. By opening the access cover 21, an opening for exposing a main part of the recording mechanism portion in the main case 22 can be defined. The access cover 21 is opened when the ink jet cartridge 1 is exchanged or when the maintenance of the recording mechanism portion of the ink jet recording apparatus is performed.

Figure 3:
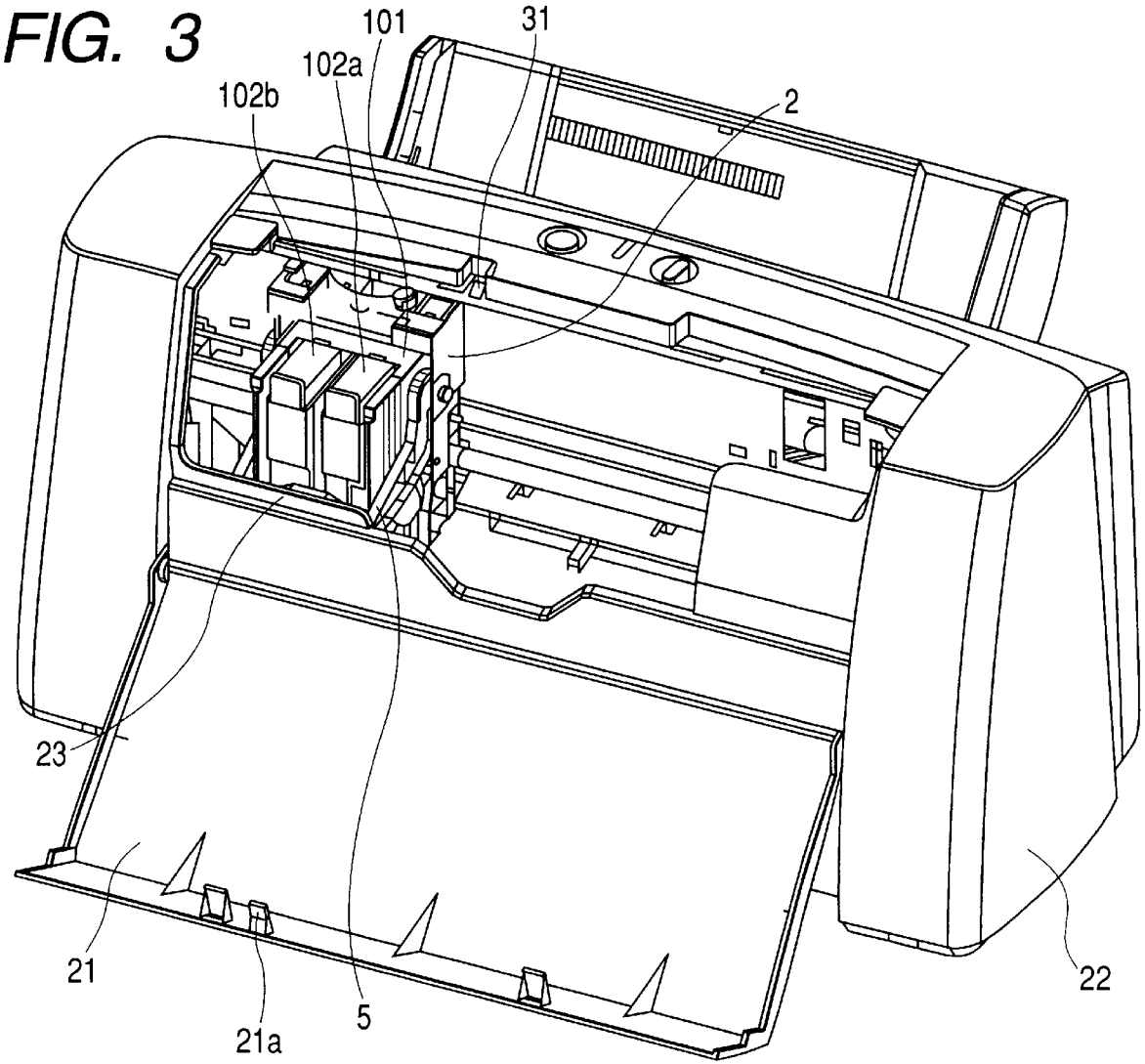
FIG. 3 is a perspective view of the jet recording apparatus of FIG. 1 in a condition that an access cover is opened and a carriage is in an ink tank exchanging position.

FIG. 3 is a perspective view showing the appearance in a condition that the access cover 21 is opened. If the ink in at least one of two ink tanks 102*a*, 102*b* is used up, the user opens the access cover 21 in order to exchange the vacant ink tank 102*a* or 102*b*. Incidentally, it is preferable that the ink jet recording apparatus is provided with an ink detection sensor for detecting the remaining amount or presence/absence of the ink in the ink tanks 102*a*, 102*b* in order to inform the user of the presence/absence of the ink in the ink tanks 102*a*, 102*b*.

Since the ink jet recording apparatus includes cover open/close detection sensor for detecting the fact that the access cover 21 is opened, the opened condition of the access cover 21 can be detected.

The cover open/close detection sensor includes a sensor 31 provided on the main case 22, and a projection 21*a* integrally provided on the access cover 21 so as to act on the sensor 31 when the access cover 21 is closed. For example, an optical sensor can be used as the sensor 31. In this case, by detecting the projection 21*a* by means of the sensor 31, it can be detected whether the access cover 21 is opened or closed. Further, in place of the sensor 31, a switch for effecting connection and interruption of electrical communication may be used. In this case, by adopting an arrangement the switch is turned ON and OFF when the projection 21*a* is and is not contacted with the switch, respectively, it can be detected whether the access cover is opened or closed. Further, in place of the sensor 31, a cover lever may be provided for causing the cover lever to turn ON/OFF a switch provided in the recording apparatus in such a manner that the switch is turned ON/OFF by the projection 21*a* via the cover lever.

When the fact that the access cover 21 is opened is detected by the cover open/close detection means, an ink tank exchange mode is established, and, in this mode, the control portion of the ink jet recording apparatus shifts the carriage 2 to an ink tank exchanging position as shown in FIG. 3. In this illustrated embodiment, the ink tank exchanging position is set at a left end in FIG. 3 opposite to the home position.

Figure 4:
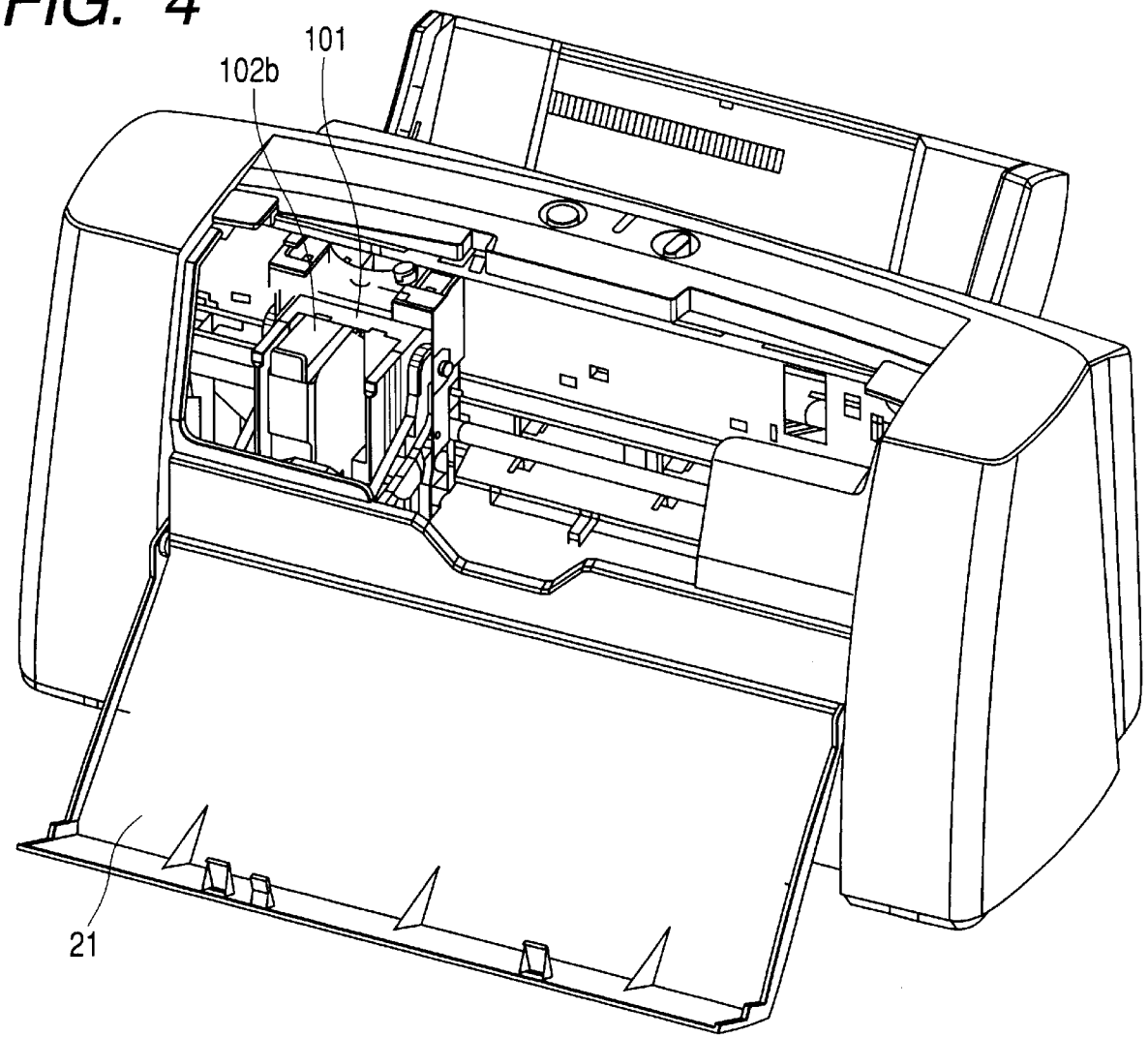
FIG. 4 is a perspective view showing a condition that an ink tank was dismounted at the ink tank exchanging position shown in FIG. 3.

In the ink tank exchanging position, a wall 23 is integrally formed with the opening portion of the main case 22. The wall 23 is provided at a position where the user cannot manipulate the operation portion for the head securing lever 5 or where, if the user tries to rotate the head securing lever 5, he is interfered with the head securing lever 5 so that he cannot rotate the head securing lever 5. Thus, in the ink tank exchanging position, the user cannot dismount the recording head portion 101 from the carriage 2. However, the ink tanks 102*a* 102*b* can freely be dismounted from the ink jet cartridge 1 and accordingly from the recording head portion 101 regardless of the operation of the head securing lever 5. FIG. 4 shows a condition that only one ink tank 102*a* was dismounted and only the other ink tank 102*b* is still mounted to the recording head portion 101.

In this way, by providing the arrangement for regulating the operation of the head securing lever used for dismounting the recording head portion 101 or the ink jet cartridge 1 when the carriage 2 is in the ink tank exchanging position, the possibility that the operator who tries to dismount the ink tanks 102*a*, 102*b* erroneously dismounts the recording head portion 101 or the ink jet cartridge 1 when the carriage 2 is eliminated. Further, since the carriage 2 is shifted to the ink tank exchanging position merely by opening the access cover 21 by the operator, the ink tanks 102*a*, 102*b* having exchanging frequency greater than that of the recording head portion 101 can easily be exchanged.

After the ink tanks 102*a*, 102*b* are dismounted from the recording head portion 101 and new ink tanks are mounted, the operator closes the access cover 21. When the fact that the access cover 21 is closed is detected by the cover open/close detection means, the control portion of the ink jet recording apparatus shifts the carriage 2 to the home position. Thereafter, the recovery processing of the ink jet cartridge 1 is effected by the recovery unit 7 to establish a waiting condition of the ink jet recording apparatus. The recovery processing effected here is least recovery processing required when the ink tanks 102*a*, 102*b* are exchanged, such as processing for removing bubbles entered into an ink path from the ink tanks 102*a*, 102*b* to the recording head portion 101. Accordingly, an amount of ink consumed in this recovery processing is small in comparison with an amount of ink consumed in recovery processing (described later) when the recording head portion 101 is exchanged.

Next, the exchanging of the ink jet cartridge 1 will be explained. Incidentally, in the illustrated embodiment, since the exchanging of the ink jet cartridge 1 means the exchanging of the recording head portion 101, such explanation is the same as explanation of the exchanging of the recording head portion 101.

Since the exchanging of the ink jet cartridge 1 is substantially effected when the exchanging of the recording head portion 101 is required, the exchanging frequency thereof is considerably smaller or lower than the exchanging frequency of the ink tanks 102*a*, 102*b*. Further, the head recovery processing thereof differs from that after the exchanging of the ink tanks 102*a*, 102*b*. Thus, the exchanging of the ink jet cartridge 1 is performed in an operation mode different from the operation mode regarding the exchanging of the ink tanks 102*a*, 102*b*.

First of all, similar to the exchanging of the ink tanks 102*a*, 102*b*, the access cover 21 is opened. As a result, the ink jet recording apparatus enters into the ink tank exchanging mode, and the carriage 2 is shifted to the ink tank exchanging position as shown in FIG. 3.

In the illustrated embodiment, by performing a predetermined operation in this condition, the ink jet recording apparatus is transferred from the ink tank exchanging mode to an ink jet cartridge exchanging mode. More specifically, the control portion of the ink jet recording apparatus is designed so that, when the reset button 24 continues to be depressed by a predetermined time period (for example, three seconds) or more, the apparatus is transferred to the ink jet cartridge exchanging mode. Alternatively, a button for transferring to the ink jet cartridge exchanging mode may be provided separately so that the ink jet cartridge exchanging mode can be established by manipulating this button.

Figure 5:
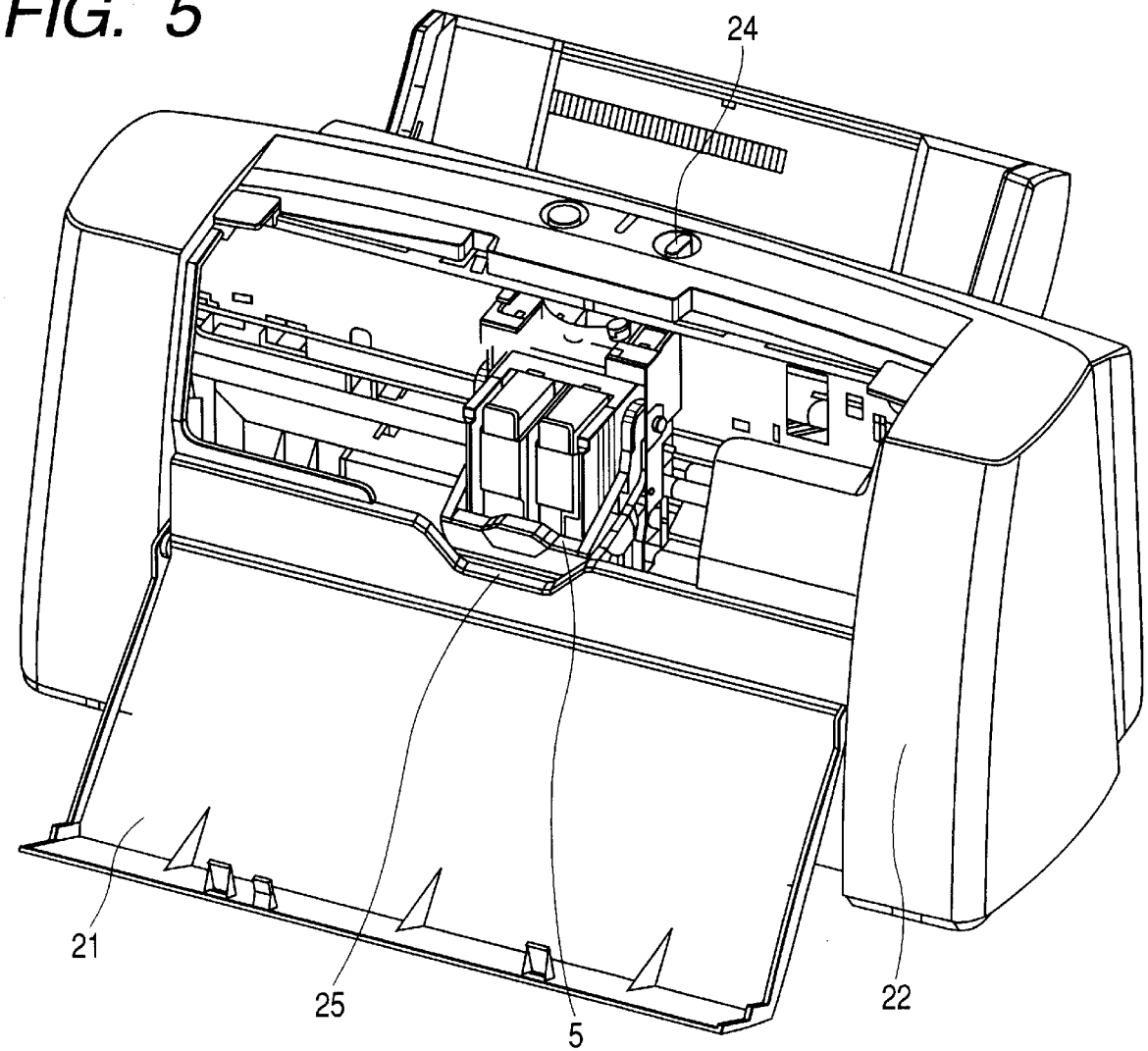
FIG. 5 is a perspective view of the jet recording apparatus of FIG. 1 in a condition that the carriage is in an ink jet cartridge exchanging position.

When the ink jet recording apparatus is transferred to the ink jet cartridge exchanging mode, as shown in FIG. 5, the carriage 2 is shifted to an ink jet cartridge exchanging position which is intermediate of the carriage shifting range.

Figure 6:
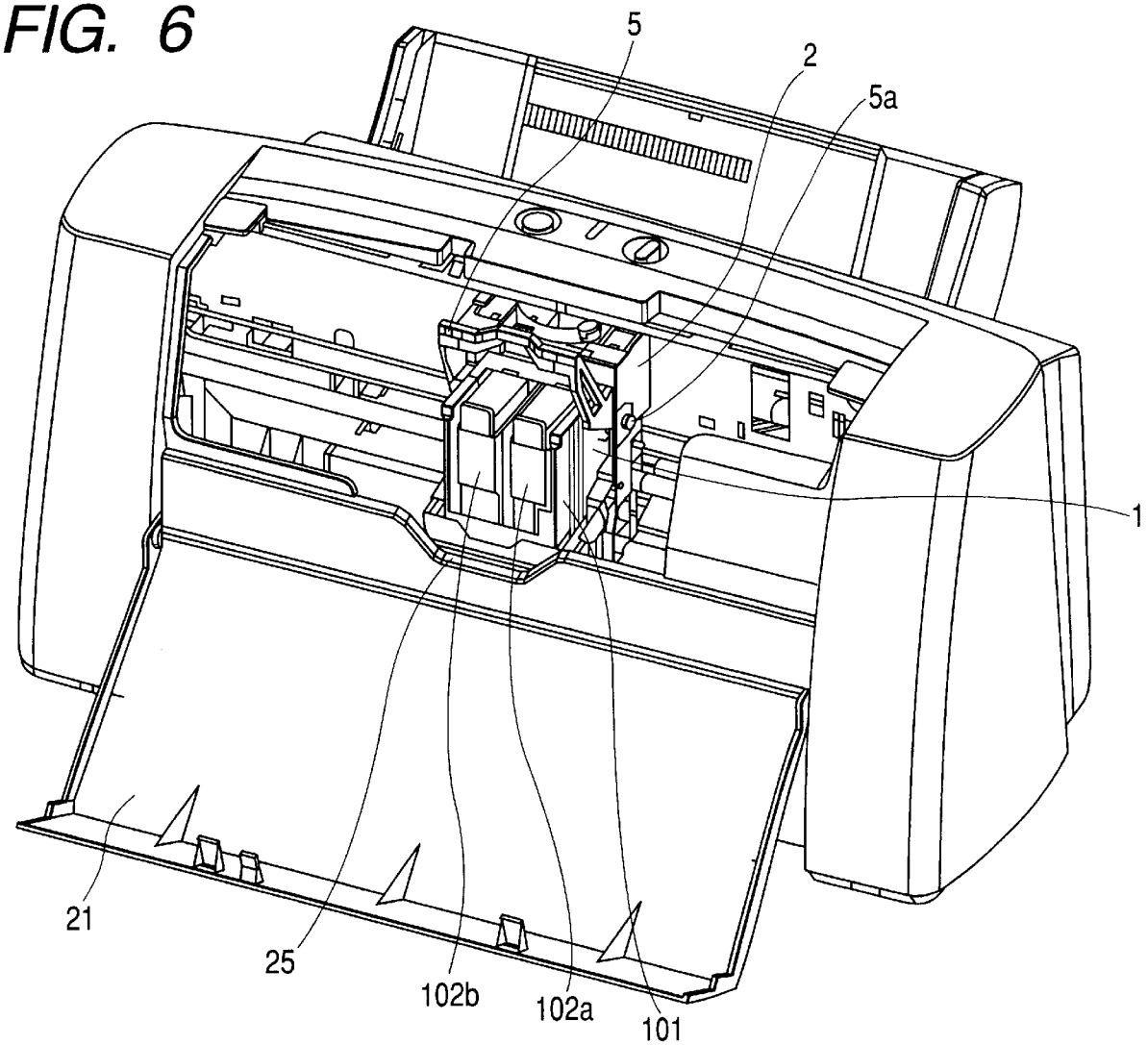
FIG. 6 is a perspective view showing a condition that securing of an ink jet cartridge to the carriage is released by rotating a securing lever at the ink jet cartridge exchanging position shown in FIG. 5.
Figure 7:
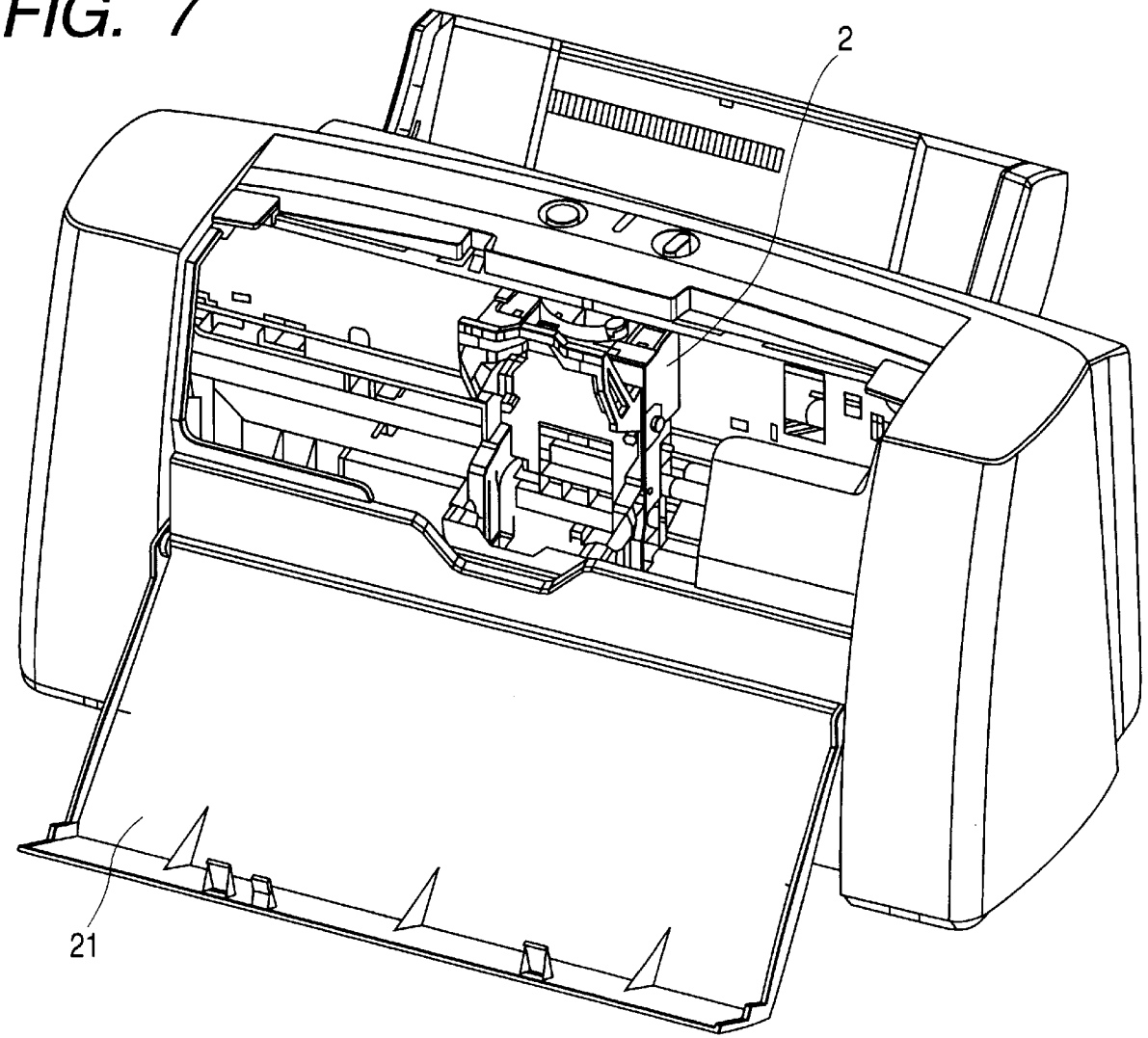
FIG. 7 is a perspective view showing a condition that the ink jet cartridge was removed from the condition shown in FIG. 6.

In the ink jet cartridge exchanging position, a notched portion 25 is provided in the opening portion of the main case 22, and a space through which the operation portion for the head securing lever 5 can be manipulated is defined by the notched portion 25. Accordingly, in this position, as shown in FIG. 6, the operator can rotate the head securing lever 5 around the support shaft 5*a* to release the securing of the ink jet cartridge 1 to the carriage 2, with the result that the ink jet cartridge 1 with the ink tanks 102*a*, 102*b* mounted thereto can be detached from the carriage 2. FIG. 7 is a perspective view showing a condition that the ink jet cartridge 1 is dismounted from the carriage 2.

After the ink jet cartridge 1 is dismounted from the carriage 2, the operator can exchange the entire ink jet cartridge 1 or the recording head portion 101 to a new one, and closes the access cover 21. When the fact that the access cover 21 is closed is detected by the cover open/close detection means, the control portion of the ink jet recording apparatus shifts the carriage 2 to the home position. Thereafter, the recovery processing of the ink jet cartridge 1 is performed by the recovery unit 7. After the ink jet cartridge exchanging mode is finished, the waiting condition of the ink jet recording apparatus is established.

The recovery processing in the ink jet cartridge exchanging mode differs from the recovery processing in the ink tank exchanging mode. That is to say, when the recording head portion 101 is exchanged to a new one, since there may be time-lapse change in the discharging property of the recording head portion 101 upon manufacturing, aging drive operation such as special preliminary discharge for recovering such time-lapse change must be performed, or, since the ink existing in the nozzles may be viscosity-increased in a time-lapsed manner during the material transportation, such viscosity ink must be removed by suction and the like. Accordingly, an amount of ink consumed in this ink jet cartridge exchanging mode is great in comparison with the amount of ink consumed during the recovery processing in the ink tank exchanging mode.

Incidentally, when only the recording head portion 101 is exchanged, mounting and dismounting of the ink tanks 102*a*, 102*b* with respect to the recording head portion 101 are also effected. In this case, since bubbles may enter into the ink path from the ink tanks 102*a*, 102*b* to the recording head portion 101, the entered bubbles can be well removed by the recovery processing in the ink jet cartridge exchanging mode.

As mentioned above, by providing the ink tank exchanging position for exchanging the ink tanks 102*a*, 102*b* and the ink jet cartridge exchanging position for exchanging the ink jet cartridge (i.e., recording head exchanging position for exchanging the recording head portion 101) at different positions, optimum structures for elements to be exchanged are adopted at the respective positions so that the ink tanks 102*a*, 102*b* can easily be exchanged at the ink tank exchanging position and the ink jet cartridge 1 can easily be exchanged at the ink jet cartridge exchanging position (the recording head portion 101 can easily be exchanged at the recording head exchanging position).

Further, by effecting the exchanging of the ink tanks 102*a*, 102*b* and the exchanging of the recording head portion 101 (the ink jet cartridge 1) in different operation modes, the recovery processing for the ink jet cartridge 1 can be set to be optimum in accordance with the elements to be exchanged. As a result, the amount of ink consumed in the recovery processing can be minimized, thereby enhancing utilizing efficiency of the ink to the recording. Particularly, since the exchanging frequency of the ink tanks 102*a*, 102*b* is greater or higher than that of the recording head portion 101, reduction in the amount of ink consumed in such recovery processing after the exchanging of the ink tanks is advantageous in the point that the utilizing efficiency of the ink to the recording is enhanced.

In addition, since the carriage 2 is automatically shifted to the ink tank exchanging position by opening the access cover 21 and, thereafter, can be shifted to the ink jet cartridge exchanging position by the specific operation, if the operator who tries to exchange the ink jet cartridge dismounts only the ink tanks 102*a*, 102*b* at the ink tank exchanging position erroneously and then he is aware of such error, the operator can re-mounts the dismounted ink tanks 102*a*, 102*b* and performs the specific operation, with the result that the carriage can be shifted to the ink jet cartridge exchanging position without effecting the recovery processing. Further, when the exchanging of the ink tanks 102*a*, 102*b* is not needed, if the operator opens the access cover 21 erroneously, by closing the access cover 21 as it is, the recovery processing in the ink tank exchanging mode is effected. However, since the amount of ink consumed in this recovery processing is small, if the operation causing the recovery processing was carried out erroneously, an amount of ink wasted can be minimized.

It is preferable that the ink jet recording apparatus is provided with cartridge detection means for detecting whether or not the ink jet cartridge 1 is mounted on the carriage 2. With this arrangement, after the ink jet cartridge 1 is dismounted from the carriage 2, if the operator forgets to mount a new ink jet cartridge 1 and then closes the access cover 21, the fact that the ink jet cartridge 1 is not mounted can be informed to the operator.

In such a case, the operator opens the access cover 21 to mount the ink jet cartridge 1. In the above-mentioned operation, when the access cover 21 is opened, since the carriage 2 is shifted to the ink tank exchanging position, the operator must perform the specific operation (more specifically, depress the reset button 24 for three seconds or more) to shift the carriage 2 to the ink jet cartridge exchanging position. By adopting an arrangement in which, after the fact that the ink jet cartridge 1 is not mounted on the carriage 2 is detected by the cartridge detection means, when the access cover 21 is opened, the carriage 2 is directly shifted to the ink jet cartridge exchanging position, the ink jet cartridge 1 can easily be mounted.

Regarding the forwarding of the ink jet recording apparatus from the factory, there are a case where the apparatus is forwarded in a condition that the ink jet cartridge is mounted on the carriage and a case where the apparatus is forwarded in a condition that the ink jet cartridge is not mounted on the carriage. In the latter case, the operator who newly bought the ink jet recording apparatus must firstly mount the ink jet cartridge on the carriage to establish the waiting condition. In this case, the above-mentioned function is advantageous.

As mentioned above, in the illustrated embodiment, while an example that the ink tank exchanging position is set at a position opposite to the home position and the ink jet cartridge exchanging position is set at a position substantially in the middle of the carriage shifting range was explained, the ink tank exchanging position and the ink jet cartridge exchanging position are not limited to such positions so long as they are different from each other, and such exchanging positions can be set appropriately in accordance with layout of various parts and units constituting the ink jet recording apparatus.

As mentioned above, according to the present invention, by providing the ink tank exchanging position for exchanging the ink tanks and the ink jet cartridge exchanging position for exchanging the ink jet cartridge at different positions, the structure optimum to the exchanging of the ink tanks can be adopted in the ink tank exchanging position and the structure optimum to the exchanging of the ink jet cartridge can be adopted in the ink jet cartridge exchanging position, thereby realizing an ink jet recording apparatus in which the ink tanks and the recording head (ink jet cartridge) can easily be exchanged. Particularly, by providing the recording head dismounting preventing structure for inhibiting the dismounting of the recording head from the carriage at the ink tank exchanging position, erroneous dismounting of the recording head at the ink tank exchanging position can be prevented positively.

Further, when the recovery means for effecting the recovery processing of the recording head is provided, by differentiating the recovery processing after shifted to the ink tank exchanging position from the recovery processing after shifted to the recording head exchanging position, a consumed amount of useless ink not used in the recording can be suppressed. Further, by adopting the arrangement in which the carriage is shifted to the ink tank exchanging position by the opening/closing operation of the cover, the ink tanks having higher exchanging frequency can be exchanged more easily.

What is claimed is:

1. An ink jet recording apparatus including a carriage to which a recording head for effecting recording on a recording material by discharging ink and an ink tank for containing ink to be supplied to said recording head are detachably mounted in a separate exchanging permitting manner and which shifts said recording head and said ink tank in a direction perpendicular to a conveying direction of the recording material, the ink jet recording apparatus comprising:

an ink tank exchanging position which is a position of said carriage, where said ink tank is to be exchanged; and a recording head exchanging position which is different from the ink tank exchanging position and which is a position of the carriage where said recording head is to be exchanged.

2. An ink jet recording apparatus according to claim 1, wherein a recording head dismounting preventing structure for inhibiting dismounting of said recording head from said carriage is provided at said ink tank exchanging position.

3. An ink jet recording apparatus according to claim 2, wherein said carriage is provided with a lever member for holding said recording head to said carriage and for releasing said recording head from said carriage; and said recording head dismounting preventing structure has a wall structure by which the operator cannot manipulate an operation portion for said lever member.

4. An ink jet recording apparatus according to claim 3, wherein said wall structure is formed on a part of an outer frame of the ink jet recording apparatus.

5. An ink jet recording apparatus according to claim 2, wherein said carriage is provided with a lever member for holding said recording head to said carriage and for releasing said recording head from said carriage; and said recording head dismounting preventing structure has a wall structure for regulating a movement of said lever member in a direction along which holding of said recording head is released.

6. An ink jet recording apparatus according to claim 5, wherein said wall structure is formed on a part of an outer frame of the ink jet recording apparatus.

7. An ink jet recording apparatus according to claim 1, wherein a space for permitting dismounting of said recording head from said carriage is formed in said recording head exchanging position.

8. An ink jet recording apparatus according to claim 7, wherein the space is formed by notching a part of an outer frame of the ink jet recording apparatus.

9. An ink jet recording apparatus according to claim 1, further comprising head recovery means for effecting recovery processing for forcibly discharging the ink from said recording head to recover and maintain a discharging property of said recording head, rather than the recording; and wherein in the recovery processing effected by said head recovery means, recovery processing after shifted to said ink tank exchanging position differs from recovery processing after shifted to said recording head exchanging position.

10. An ink jet recording apparatus according to claim 9, wherein an amount of the ink consumed in the recovery processing after shifted to said ink tank exchanging position is greater than an amount of the ink consumed in the recovery processing after shifted to said recording head exchanging position.

11. An ink jet recording apparatus according to claim 1, wherein said carriage is shifted to said recording head exchanging position by effecting a specific operation in a condition that said carriage is in said ink tank exchanging position.

12. An ink jet recording apparatus according to claim 11, wherein the specific operation is manipulation of a button provided on the ink jet recording apparatus.

13. An ink jet recording apparatus according to claim 1, further comprising an openable/closable cover, and cover open/close detection means for detecting opening and closing of said cover; and wherein when the fact that said cover is opened is detected by said cover open/close detection means, said carriage is shifted to said ink tank exchanging position.

14. An ink jet recording apparatus according to claim 13, wherein, when the fact that said cover is opened is detected by said cover open/close detection means in a condition that said ink jet cartridge is not mounted to said carriage, said carriage is shifted to said recording head exchanging position.

15. An ink jet recording apparatus according to claim 1, wherein said recording head has an electrothermal converter for generating thermal energy as an energy generating member for generating energy utilized for discharging the ink.

16. An ink jet recording apparatus comprising:

conveying means for conveying a recording medium; and a carriage for mounting a recording head for discharging ink to record on the recording medium and an ink tank for supplying ink to said recording head, said recording head and said ink tank being separately and exchangeably mounted on said carriage, wherein said carriage has an ink tank exchanging position for exchanging said ink tank and a recording head exchanging position for exchanging said recording head, which is different from said ink tank exchanging position.

17. An ink jet recording apparatus according to claim 16, wherein a recording head dismounting preventing structure for inhibiting dismounting of said recording head from said carriage is provided at said ink tank exchanging position.

18. An ink jet recording apparatus according to claim 17, wherein said carriage is provided with a lever member for holding said recording head to said carriage and for releasing said recording head from said carriage; and said recording head dismounting preventing structure has a wall structure by which an operator cannot manipulate an operation portion for said lever member.

19. An ink jet recording apparatus according to claim 18, wherein said wall structure is formed on a part of an outer frame of the ink jet recording apparatus.

20. An ink jet recording apparatus according to claim 17, wherein said carriage is provided with a lever member for holding said recording head to said carriage and for releasing said recording head from said carriage; and said recording head dismounting preventing structure has a wall structure for regulating a movement of said lever member in a direction along which holding of said recording head is released.

21. An ink jet recording apparatus according to claim 20, wherein said wall structure is formed on a part of an outer frame of the ink jet recording apparatus.

22. An ink jet recording apparatus according to claim 16, wherein a space for permitting dismounting of said recording head from said carriage is formed in said recording head exchanging position.

23. An ink jet recording apparatus according to claim 22, wherein the space is formed by notching a part of an outer frame of the ink recording apparatus.

24. An ink jet recording apparatus according to claim 16, further comprising head recovery means for effecting recovery processing for forcibly discharging the ink from said recording head to recover and maintain a discharging property of said recording head, rather than the recording; and wherein in the recovery processing effected by said head recovery means, recovery processing after shifted to said ink tank exchanging position differs from recovery processing after shifted to said recording head exchanging position.

25. An ink jet recording apparatus according to claim 24, wherein an amount of the ink consumed in the recovery processing after shifted to said ink tank exchanging position is greater than an amount of the ink consumed in the recovery processing after shifted to said recording head exchanging position.

26. An ink jet recording apparatus according to claim 16, wherein said carriage is shifted to said recording head exchanging position by effecting a specific operation in a condition that said carriage is in said ink tank exchanging position.

27. An ink jet recording apparatus according to claim 26, wherein the specific operation is manipulation of a button provided on the ink jet recording apparatus.

28. An ink jet recording apparatus according to claim 16, further comprising an openable/closable cover, and cover open/close detection means for detecting opening and closing of said cover; and wherein when the fact that said cover is opened is detected by said cover open/close detection means, said carriage is shifted to said ink tank exchanging position.

29. An ink jet recording apparatus according to claim 28, wherein, when the fact that said cover is opened is detected by said cover open/close detection means in a condition that said recording head is not mounted to said carriage, said carriage is shifted to said recording head exchanging position.

30. An ink jet recording apparatus according to claim 16, wherein said recording head has an electrothermal converter for generating thermal energy as an energy generating member for generating energy utilized for discharging the ink.

* * * * *

UNITED STATES PATENT AND TRADEMARK OFFICE

CERTIFICATE OF CORRECTION

PATENT NO. : 6,739,692 B2
DATED : May 25, 2004
INVENTOR(S) : Yasuhiro Unosawa

It is certified that error appears in the above-identified patent and that said Letters Patent is hereby corrected as shown below:

Column 1,
Line 25, “for in” should read -- for an --; and
Line 46, “are a” should read -- is a --.

Column 2,
Line 10, “exchange” should read -- exchanged --; and
Line 32, “or the” should read -- or --.

Column 4,
Lines 3 and 9, “ink” should read -- ink jet --.

Column 13,
Line 40, “said ink jet cartridge” should read -- said ink jet recording head --.

Column 14,
Line 24, “ink” should read -- ink jet --.

Signed and Sealed this

Twenty-eighth Day of September, 2004

JON W. DUDAS
*Director of the United States Patent and Trademark Office*